United States Patent [19]

Payne

[11] Patent Number: 4,527,657

[45] Date of Patent: Jul. 9, 1985

[54] TAPERED TUBE IMPEDANCE MATCHING UNDERWATER VOICE COMMUNICATOR WITH BUBBLE SILENCER

[76] Inventor: Philip W. Payne, 157 Cocoa Ave., Indialantic, Fla. 32903

[21] Appl. No.: 636,327

[22] Filed: Jul. 31, 1984

[51] Int. Cl.[3] ..... G10K 11/00; F01N 7/12

[52] U.S. Cl. ..... 181/18; 181/21; 181/22; 181/127; 181/173; 181/175; 181/198; 181/235; 181/252; 128/200.29; 128/201.19; 367/132

[58] Field of Search ..... 181/18, 21, 22, 127, 181/173, 175, 198, 247, 252, 235; 128/200.29, 201.19; 367/132

[56] References Cited

U.S. PATENT DOCUMENTS

| | | | |
|---|---|---|---|
| 3,123,680 | 3/1964 | Minton, Jr. et al. | 128/201.19 X |
| 3,174,129 | 3/1965 | Laughlin et al. | 128/201.19 X |
| 3,210,723 | 10/1965 | Martelli et al. | 128/201.19 X |
| 3,347,230 | 10/1967 | Cupp | 128/201.19 |
| 3,828,887 | 8/1974 | Alexander | 367/132 X |
| 4,031,888 | 6/1977 | Walters | 128/201.19 |
| 4,071,110 | 1/1978 | Payne | 128/201.19 X |
| 4,183,422 | 1/1980 | Williams | 128/201.19 X |

*Primary Examiner*—Benjamin R. Fuller
*Attorney, Agent, or Firm*—Jeffrey M. Ketchum

[57] ABSTRACT

An underwater voice communicator in which the preferred embodiment comprises a pair of tapered tubes in communication with a diver's mouth. The tubes are constructed of a material having a sound impedance similar to the sound impedance of water. Sound energy issuing from the mouth of a diver is reflected down the length of the tapered tubes to an area of the tube that concentrates the sound for injection into the surrounding water.

17 Claims, 6 Drawing Figures

TAPERED TUBE IMPEDANCE MATCHING UNDERWATER VOICE COMMUNICATOR WITH BUBBLE SILENCER

This invention relates broadly to scuba (Self Contained Underwater Breathing Apparatus) and more particularly to an improved underwater voice communicator which provides increased sound projection and can be substituted for the normal mouthpiece provided with the scuba equipment. It includes a silencer to still one of the greatest impediments of proper underwater voice communication: the obscuring noise generated by a diver's exhaust bubbles as they issue past his face. This can be substituted for the normal exhaust piece provided with scuba equipment and is described and claimed in my copending application Ser. No. 636,328, filed on even data herewith.

BACKGROUND

The use of Self Contained Underwater Breathing Apparatus has increased free-diving operations greatly over recent years, permitting divers to enter the sea for a diversity of work and recreation activities. In this environment there are hazards not found in the terrestrial environment. These include dangers of sharks, poisonous stings, nitrogen narcosis, embolisms, entrapments, disorientation, entanglement in monofilament fishing lines, exhaustion, panic and drowning. Because of these hazards, virtually all agencies that instruct and certify divers teach that one must always be accompanied by a "buddy".

In underwater work and sport two divers together have great need to communicate with one another over the details of approach to said work or sport. The constant decision over navigation as well as the constant need to express individual observations require a communication system to greatly enrich the diving experience.

However, despite all attempts to create an affordable, functional, and convenient underwater talking mechanism, one has not been made or marketed. Without such a much-needed invention, divers are virtually mute. The loudest shout into present-day breathing apparatus only slightly enters the sound-conducting medium of the water and can rarely be heard by an adjacent diver. Communication is therefore reduced to hand signals. These are capable of only rudimentary expression and only when there is direct visual contact between the parties. Such directed attention precludes most other desired underwater activity, even when the water is clear. Often it is not clear, and this rudimentary mode of communication is then virtually impossible. For these reasons, since diver-to-diver communication is so difficult, the help that a buddy-diver could give in any instance of trouble, if expression of the danger or of predicament were more possible, is largely compromised. Consequently, divers ignore the hazards to some extent and dive, if with a "buddy", with little or no communication.

Many attempts have been made to provide divers with voice communication means. Indeed, the surrounding medium of sea- or fresh-water is an excellent conductor of sound. Sound energy, once in the water, is easily heard through the bones of the face and skull. But these attempts have failed to make a complete and simple solution for reasons to be recounted.

The teachings of Laughlin et al., U.S. Pat. No. 3,174,129, and of Martelli et al., U.S. Pat. No. 3,210,723, refer to electromagnetic mechanisms wherein the diver's voice is picked up in an enclosure around the mouth which contains a microphone which then causes an electromagnetic device to issue the sound into the water. Although such devices can be made to function with distance and sufficient clarity to provide inter-diver communication, they are subject to distortion of the sound, a nuisance, and to seawater leakage which in electrical circuits is a disaster. Whether for these reasons or because they are relatively expensive, combersome and inconvenient, such devices have not found a significant niche in the diver market to provide a solution to the problem of diver muteness.

The teachings of Hogan et al., U.S. Pat. No. 2,844,212, and of Alexander, U.S. Pat. No. 3,828,887, though professing a diaphragm means for the issue of sound into the surrounding water, are ineffective. This is because the diaphragm, having one face in contact with the water and the opposite in contact with the air, sits at the interface between two media of widely different acoustic impedances. Sound in air is almost completely reflected back into the air from these diaphragms without entering the water. Audible sounds passed are so faint as to require great acoustic silence for another diver to hear them, even at a distance of less than arm-length. Ordinarily, the sound environment of the marine diver is noisy due to sounds of molusks, fish, water movements and of the greatest noise generator, almost constantly present, the diver's exhalation bubbles. A major problem to the understandable perception of even quite loud underwater voice sounds in this noise of exhalation bubbles issuing from each diver's breathing regulator. That these bubbles normally pass the face, still generating some noise as they grow and coalesce, is a further disturbance to the sense of hearing of each individual diver.

The teachings of Minton et al., U.S. Pat. No. 3,123,680, Cupp et al., U.S. Pat. No. 3,347,230, and of Walters, U.S. Pat. No. 4,031,888, are merely mouth surrounds which permit lip movements of speech but which have no mechanical sound-emitting mechanisms in their makeup as in Hogan and Alexander. Although all are professedly to facilitate a microphone, Walters professes some "limited distance" effectiveness with his invention unassisted. That distance on all such devices, by this inventor's research, is so short as to be impractical, again due to lack of any means to match acoustical impedances.

This applicant's prior U.S. Pat. No. 4,071,110 provides a mouthpiece attached to the normal scuba regulator to accommodate normal breathing and with mechanical means to transfer a voice to the surrounding water through an acoustic impedance-match by means of a mechanical transformer, consisting of a diaphragm, lever system, and emitter.

The teachings of Williams, U.S. Pat. No. 4,183,422, reveal a balloon means which, if held to the mouth, involving both hands and the removal of the breathing regulator mouthpiece, can be inflated with some or most of the divers available breath and then, with the remaining held breath, spoken into to communicate to another diver. This devising has been know in some forms for many years. It does function, owing to the relatively large surface exposed to the impact of the voice in air, and to the multiple internal reflections without substantial reflection back into the speaker's mouth. These cause some penetration of the sound from air, through the rubber of the balloon, into the higher acoustical impedance of the water. Since no bubbles are allowed to escape, they generate no disturbance noise emanating from the speaker. The exhaust bubble noises of all listeners, nonetheless, provide masking unless they are aware of the attempted communication and suspend exhalation. While this balloon has a usable distance and clarity, though there are substantial losses, its great disadvantage is the requirement to suspend all other underwater activities, including breathing, to employ hands, mouth, and lungs in the unusual procedure which fully occupies them, preempting normal activities.

While the prior patent of this applicant provides acoustical impedance-matching means in a convenient packaging, its development has revealed a difficulty in finding sufficiently good sound-absorbent material which backs the diaphragm. The purpose of said material is to reduce nullification of sound-pressure across said diaphragm. No material has been found which can be wetted without alteration of its sound-absorbency nature. Without this its sound projection is lessened and the annoyance of bubble-noise makes communication tenuous. In addition, the diaphragm and lever mechanisms, while rugged and capable of wetting without damage, are of the nature of fine instruments, requiring some detailed adjustment and care in manufacture.

It is the purpose of this disclosure to reveal a much simpler means of acoustical impedance-matching conceived during testing of my prior invention, which means, when incorporated into the other features of an underwater communicator, eliminates need for diaphragms, levers and of emitter mechanisms, the whole being capable of simple injection molding. Also disclosed is a bubble silencer described and claimed in the previously mentioned copending application. The bubble silencer frees the diver of the proximal noise of his own bubbles and he can thus hear words of another using such a communicator.

SUMMARY OF THE INVENTION

For injection of voiced sound into the water, the present invention employs a different, non-electronic, impedance-matching principle from the use of connected air and water diaphragms sized on an area-ratio, and different from the interconnection of such devices through any amplitude-reduction mechanisms such as lever of ratioed tension-members. Rather, it employs the principle of a tapered tube of highly acute angle for concentrating sound-pressures into a small area through multiple reflections. This is a reversal of the principle of the horn.

The principle of using a smooth, gradually flaring enclosure to couple the vibrations of a substance of high acoustic impedance, the flesh of the lips in vibration, to the surrounding air for production of loud trumpet sounds has been known since men discovered this attribute in ram's horns and seashells. From these naturally occurring horn shapes humanity has gone on to couple them with tuned lengths of tubing to produce trumpets and trombones, all productive of very loud sounds in air. I reasoned that the same mechanism could be employed in reverse to match acoustical impedance of sound in air with that of sound in a denser medium, water. The essential sound-projection element of this invention is therefore an acutely tapered, hollow tube of essentially circular cross-section with a "sound window" of some thin and flexible material surrounding or across the apex. The inner wall of this tapered chamber is smooth so as to reflect acoustic energy entering at the large end, to reflect said energy specularly and with little scattering, toward the apex. Thus the sound pressures are increased until they equal those required to drive sound of essentially equal loudness in (and therefore into) the water. At such sound pressures, the sound enters the water and its energy is conducted away in that medium.

To function, this invention requires the tapered wall to be constructed of a substance which reflects sound in air. First successful models were constructed of seashells in which the tapered spiral was of smooth nacre. The small tip of the shell was ground off, and the tiny opening was covered with a thin rubber diaphragm. Somewhat remarkably, large and strongly-perceivable sound was issued from this spot into the surrounding water.

Reflection is, however, the characteristic of sound in air meeting an air-water interface. If a smooth taper can be constructed and held in the air-water interface, then the phenomenon can be caused to occur without a hard shell. For this reason, and for several other advantages to be delineated, the preferred embodiment is constructed of a rubber which has the capacity to hold a tapered internal shape within the water but which is selected to have an acoustical impedance approximately the same as that of water. Sound entering the large end and reflected toward the apex inside the rubber is concentrated by the reflection and reaches sufficient pressure that it can enter the rubber. Since the acoustic impedance of the rubber is approximately that of water, the sound then directly enters the water and is conducted away.

The preferred embodiment, to be reviewed in detail, employs two such tapers for symmetry, in combination with a mouth-fitting means, a tooth-grip means and an attachment means for adapting to the normal scuba breathing regulator. The tapered tubes are placed on either side of the neck to be unobstrusive. The rubber flexibility eliminates hazards of entanglement which might otherwise accompany such a device about the face of a diver if of hard material. The tapers are not wound into a spiral, as would accommodate occupying less volume, because water is difficult to drain from such convolutions. In the preferred embodiment, water can be allowed to enter the device without harm to it. The normal wearing position will cause any internal water to drain into the breathing regulator and be expelled.

DETAILED DESCRIPTION

Figure 3:
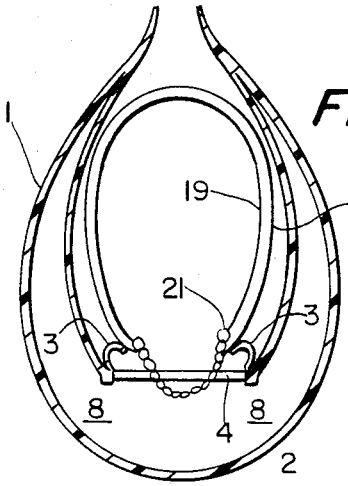
FIG. 3 is a section through a plan view of the communicator showing conformation of the inner and outer shape in relation to the flesh and skeletal outline of a diver's head.

As shown in the drawings, the invention combines the novel principle of matching the acoustical impedance of air with that of water through the use of a tapered tube 1 with, and, as part of, a general enclosure 2 which also includes a surrounding seal 3 of the mouth, conformable because of its flexibility to most human faces in a manner to prevent water leakage, a bit-bar 4, and a hollow sleeve 5 on the under side for attachment of said communicator to an ordinary scuba regulator 6, that is, in turn, connected through hose 30 to a supply of breathing air 31. Referring to FIG. 3, it will be seen that free internal communication exists between the mouth of the diver and the regulator for the purpose of free inhalation and exhalation, just as with the conventional scuba regulator mouthpiece which fits inside the mouth. In FIG. 3, it will also be seen that free internal communication exists between the mouth of the diver and the tapered tubes 1 such that voice sounds issuing from the diver's mouth are directly and easily communicated to the large openings, or "roots" 8, of said tubes. A feature of the present invention is that this communicator serves the function of the normal mouthpiece and that the diver requires no hand manipulation to be able to communicate, but can talk freely at any time into the communicator without interfering with connection to and use of his breathing apparatus and without interrupting any manual occupation.

FIG. 3 shows that the tapered tubes 1 curve around the shape of the head and that the total mouth enclosure 2 fits before the mouth so that the mouth seal 3 presses against the flesh of the head (face) 20. The bit-bar 4, anchored in the heavy wall on the inner side of the root 8, is held by the teeth 21. The outline of a section of the skull is shown at 19.

Figure 2:
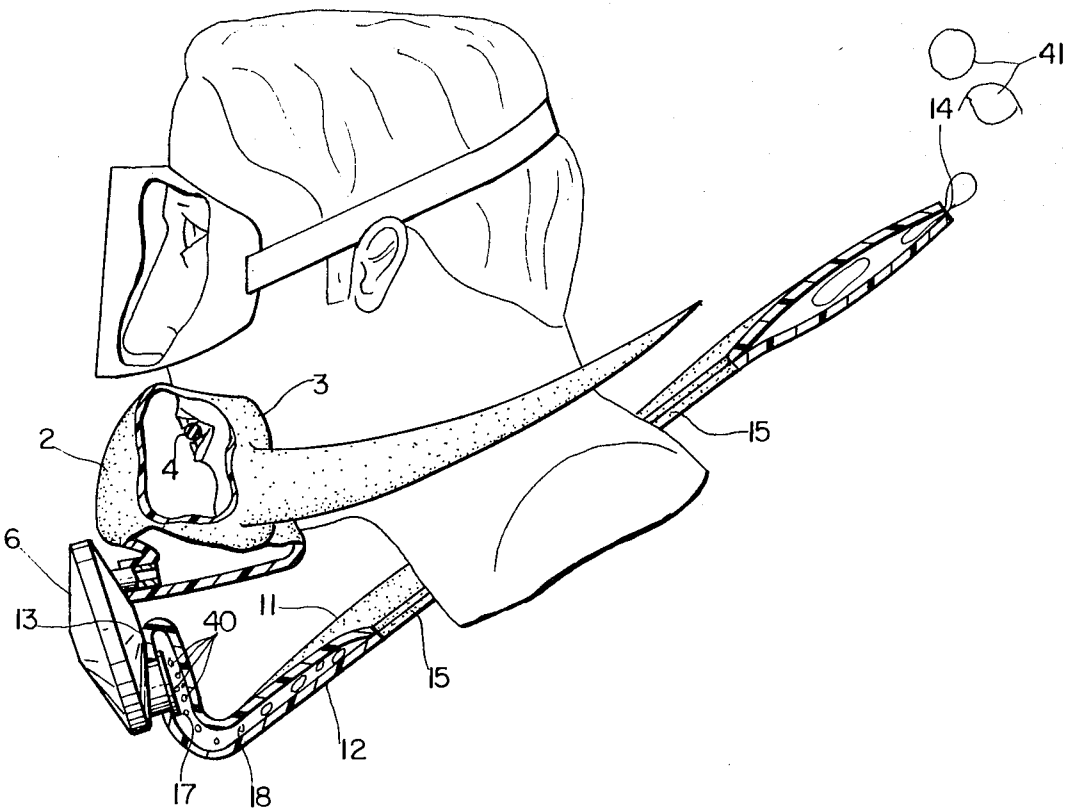
FIG. 2 is a profile view with two partial sections of said communicator and of a diver's head, showing how the bit-bar is held by the front teeth and how the communicator relates to an ordinary scuba regulator. Also in this figure said silencer is shown in cutaway view, demonstrating how it attaches to the normal exhaust port of a scuba regulator and conducts exhausted air to an exit behind the diver's head.

With reference to FIGS. 2 and 3, it will be seen that the device contains no such mechanisms as diaphragms, valves, levers, or connections to complicate the manufacture, to increase its expense, to require tuning or adjustment, nor to provide cause for corrosion of mechanical failure. Rather, the device can be produced of suitable material in a single injection molding process, requiring afterward only the addition of any suitably dimensioned and properly impressionable material for a bit-bar 4. Although construction from the assembly of elements having other characteristics is feasible, the material of the enclosure 2 in the preferred embodiment is intended to be a silicone rubber of the type which has been found to be enduring in ocean and diving usage with minimal susceptibility to rot or aging. The specific rubber to be selected is to have acoustical properties as near as possible to those of water. The acoustical impedance-matching necessary to cause the voice sounds in air to propagate into the surrounding water is thus achieved by the tapered conformation of the tubes 1. The primary advantage of the present invention is this freedom from mechanisms leading to simplicity in manufacture and durability in use.

Figure 1:
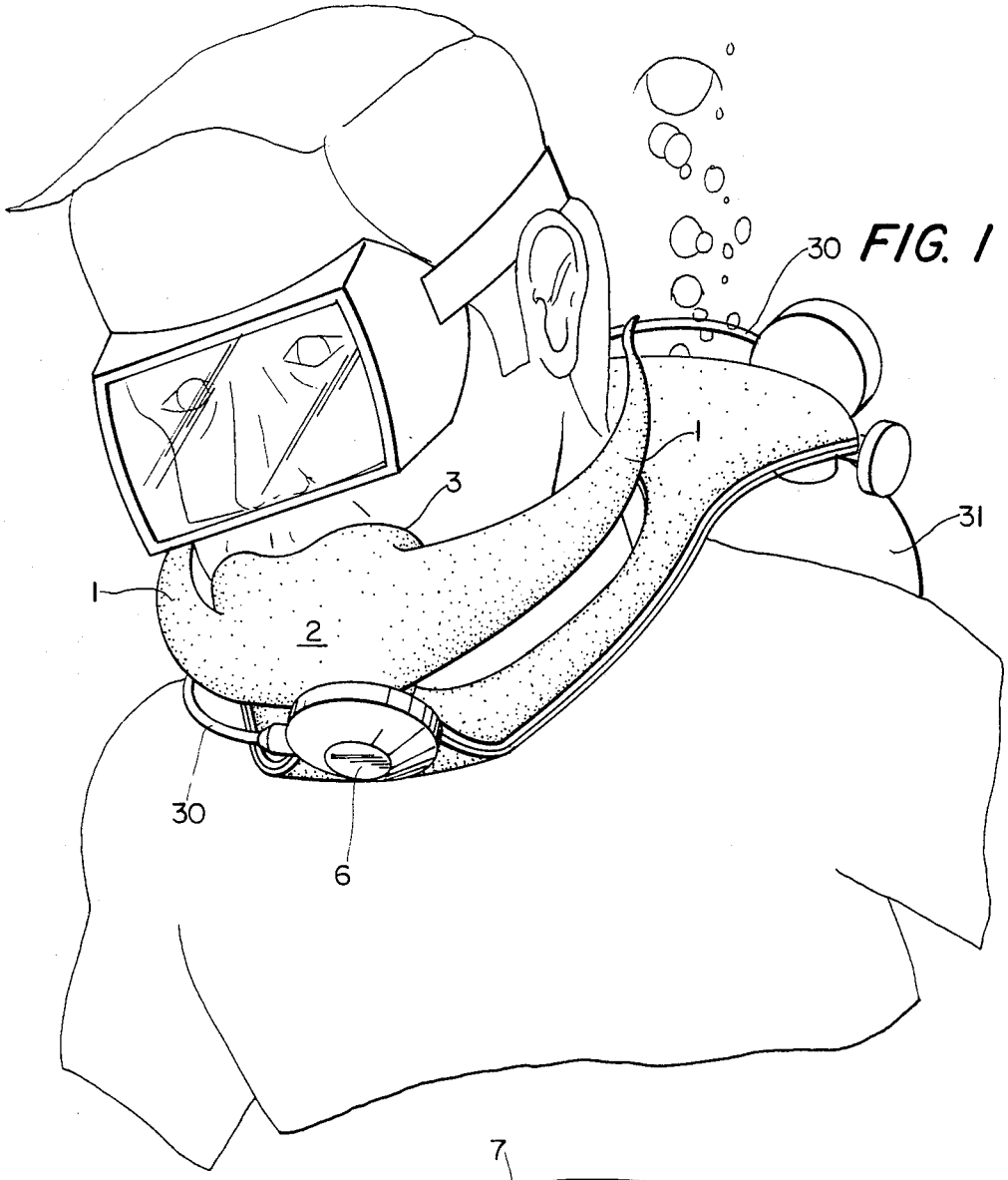
FIG. 1 is a perspective view of the preferred embodiment of the tapered tube impedance-matching underwater communicator and of the bubble-silencer as worn by a diver and as connected to a normal scuba regulator.
Figure 4:
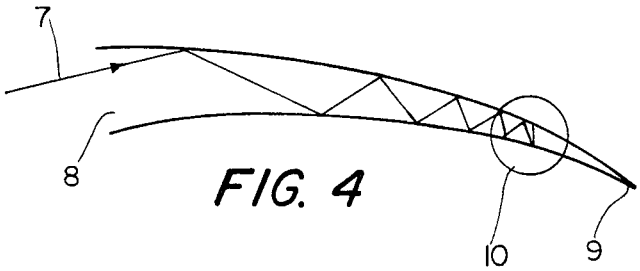
FIG. 4 is a diagram of wave reflections down a tapered tube.
Figure 6:
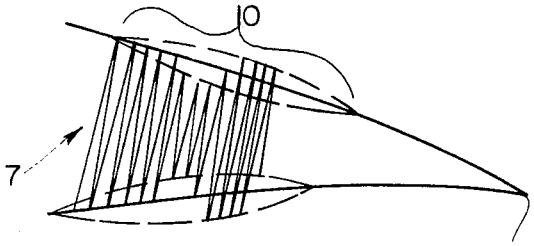
FIG. 6 is an enlargement of the circled area of FIG. 4.

Referring to FIG. 4, sound wave directions of travel, represented by lines 7 entering the large diameter or "root" 8 of the tapered tube 1 are reflected from the inner wall. The angle of reflection equals to angle of incidence. Since the tube is tapered, multiple reflections cause these angles to steepen and ultimately permit the energy from ever reaching the tip 9. Rather, they cause the energy to be concentrated at a turnaround area 10 near the tip which point has a relatively small diameter and a much smaller cross sectional area than the root 8. FIG. 6 shows that the concentration of acoustic pressure at this turnaround area 10 produces acoustic "hoop-stresses" in the rubber which expands and contracts in compliance, thus absorbing the sound and causing it to be inserted into the surrounding water. The turnaround area 10 will take up slightly different positions according to the mouth-structure of the diver and the individual mannerisms of wearing the communicator. The construction of the tapered tube 1 must, at least at this point, be of some flexible material. A major advantage of the total construction of such material, as shown in the preferred embodiment, is that the turnaround area 10 does not need to be found. The maximum of sound will emanate from that station along the tapered tube where sound-pressures become maximum. Another advantage is that some small injection of sound into the shell occurs at each reflection. Many of these occur before the turnaround area 10 is reached. Construction entirely of properly elastomeric material assures the maximum output of voice into the surrounding water.

The disposition in the preferred embodiment of the tapered tubes 1 with relatively large diameter of root 8 into a graceful curvature passing close about the diver's neck is a feature of accommodation to the hydrodynamic forces surrounding the diver as he progresses normally forward through water. In this way, the tapered tubes 1 stream naturally as conformed. They are passed over the shoulder and about the neck because this is an area about the diver which is relatively protected while being out of sight and ulikely in any way to interfere with other paraphernalia attached to or used by the diver. Neither are they likely here to be interfered with. Also, the station from which sound radiates into the water is more directly accessible to the hearing senses of an accompanying diver, or to a hydrophone in a boat above, than if situated where reflection is necessary, with possible absorption, from the seabottom.

The number and disposition of the tapered tubes 1 is not a primary characteristic of this invention. Rather they are features of the preferred embodiment. Such tubes can have much smaller root diameters 8, can be distribute in any number and in any manner connected to the mouth enclosure 2 without departing from the scope and spirit of the invention.

Figure 5:
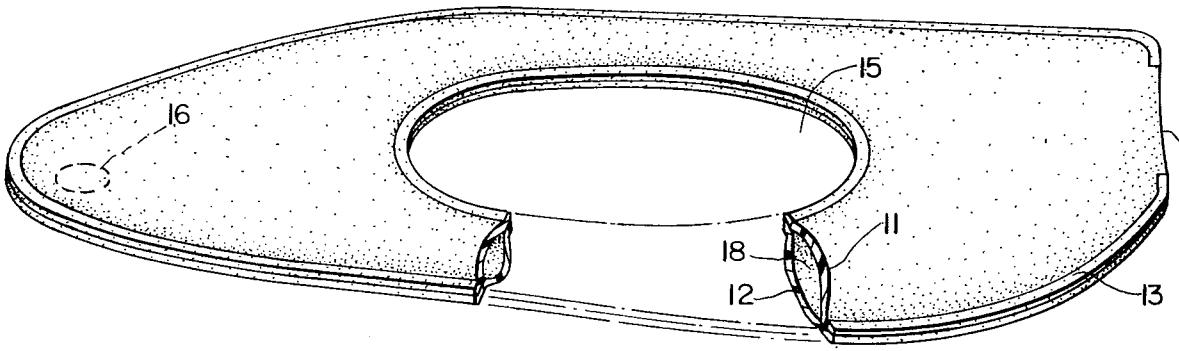
FIG. 5 is a perspective, partial sectioned view of the bubble-silencer alone.

Referring to FIGS. 2 and 5, the bubbles silencer consists of two walls 11 and 12, one on top (11) and the other on the bottom (12), cemented together around their outer margin 13 except for the rearward exhaust region 14 and cemented together around the totality of their inner margins 15 which forms the aperture for slipping the silencer over the head of the diver. The bottom wall 12 has a circular hole 16 near the forward edge. This hole permits the elastic material of the silencer to be stretched over and fitted around the exhaust port 17 of any modern scuba regulator 6. Air issued from this port, when in use in the water, enters the jacket interior 18 rather than issuing immediately into the surrounding water. This is relatively silent. Such sound as does occur is isolated from the surrounding water by the foam material of the top 11 and the bottom 12 of the jacket. Because of the looseness and the flat form of the jacket, the pneumatic pressure reflected back through the regulator exhaust valve 6 in the pressure ambient in the water outside the jacket just at the level of the exhaust. This prevents the regulator from any tendency to "free flow" or "bleed". Air within the jacket is allowed to form freely into large parcels before it issues from the rearward exhaust region 14 with little velocity and little further tendency to coalesce or to generate noise until it reaches the surface. Thus the majority of noise generation bu unsilenced scuba exhaust is avoided by means of this simply manufactured embodiment.

From all of the foregoing it will be seen that the present invention provides a breakthrough in terms of simplicity for underwater voice communication. Not only is a preponderance of the available sound of voice transferred into surrounding water, but the system itself, residing essentially in the conformation of a simply manufactured, durable, and unobtrusive shell, is not only capable of manufacture and marketing at prices every scuba diver can afford, but the mechanisms for failure such as to require replacement or repair or such as to incur safety hazards are few to non-existent. The new problem of silencing bubble-noise to permit a quite environment in which to perceive voice sound is provided an economical solution not described in the prior art.

I claim:

1. An underwater voice communicator comprising:

means defining an air chamber in communication with a diver's mouth for receiving acoustic energy from the diver's mouth, and at least one tapered tube connected to and extending from said air chamber means for receiving said acoustic energy from said air chamber, said tapered tube closed at its narrow end and having an inner wall defining a tapered air enclosure when immersed in water, said inner wall causing multiple reflections of said acoustic energy traveling toward said closed end to concentrate said energy at a turnaround area of said tube located toward said closed end, said tapered tube being of resilient material at least at said turnaround area, said concentrated energy acting to expand and contract said resilient material at said turnaround area to thereby transfer said acoustic energy in said tube to said tube wall and, thereby, to the surrounding water.

2. The underwater communicator of claim 1 wherein said air chamber means and said at least one tapered tube are of unitary construction and are integrally formed by injection molding.

3. The underwater communicator of claim 1 wherein said air chamber means further communicates with a source of breathing air through a regulator valve attached to said air chamber means.

4. The underwater communicator of claim 3 including a bubble silencer attached to said regulator valve.

5. The underwater communicator of claim 1 further comprising a bit bar attached to said communicator and held in a diver's teeth for holding said air enclosure in a fluid tight relationship to a diver's face.

6. The underwater communicator of claim 1 wherein said air chamber means has two laterally opposed sides, at least one said tapered tube extending from each of said opposed sides and positioned to extend in opposite directions around the neck of a diver when in use.

7. An underwater voice communicator comprising:

means defining an air chamber in communication with a diver's mouth for receiving acoustic energy from the diver's mouth, at least one tapered tube connected to and extending from said air chamber means for receiving said acoustic energy from said air chamber, said tapered tube closed at its narrow end and having an inner wall defining a tapered air enclosure when immersed in water, said inner wall causing multiple reflections of said acoustic energy traveling toward said closed end to concentrate said energy at a turnaround area of resilient material located toward said closed end of said tube, said concentrated energy acting to expand and contract said tube at said turnaround area to thereby transfer said acoustic energy in said tube to said tube wall and, thereby, to the surrounding water, a regulator valve attached to said air enclosure, a breathing air connection on said regulator valve, and a bubble silencer attached to said regulator valve.

8. The underwater communicator of claim 7, wherein said at least one tapered tube and said air chamber are of unitary construction and are integrally formed by injection molding.

9. The underwater communicator of claim 7 further comprising a bit bar attached to said communicator and held in a diver's teeth for holding said air enclosure in a fluid tight relationship to a diver's face.

10. An underwater voice communicator comprising:

means defining an air chamber in communication with a diver's mouth for receiving acoustic energy from the diver's mouth, and at least one tapered tube defining a tapered air enclosure having an inner wall, said tapered tube further having an open root end and a closed narrow end, said root end attached to said air chamber means for receiving acoustic energy from said air chamber means and directing said acoustic energy toward said closed narrow end, said inner wall causing multiple reflections of said acoustic energy traveling toward said closed end to concentrate said energy at a turnaround area of resilient material located toward said closed end of said tube, said concentrated energy acting to expand and contract said resilient area of said tube at said turnaround area to thereby transfer said acoustic energy in said tube to said tube wall and thereby to the surrounding water, the resilient area of said tube having an acoustical impedance approximately the same as that of water.

11. The underwater communicator of claim 10 wherein said at least one tapered tube and said air chamber are of unitary construction and are integrally formed of a resilient material by injection molding.

12. The underwater communicator of claim 10 wherein said air chamber means is further adapted to communicate with a source of breathing air through a regulator valve attached to said air enclosure.

13. The underwater communicator of claim 10 further comprising a bit bar attached to said communicator and held in a diver's teeth for holding the air enclosure in fluid tight relationship to a diver's face.

14. The underwater communicator of claim 10 wherein said air chamber means has two laterally opposed sides, at least one of said tapered tubes extending from each of said opposed sides and positioned to extend in opposite directions around the neck of a diver when in use.

15. The underwater communicator of claim 10 further comprising:

a regulator valve attached to said air enclosure, a supply of breathing air attached to said regulator valve, and a bubble silencer attached to said regulator valve.

16. The underwater communicator of claim 15 wherein said at least one tube and said air chamber are of unitary construction and are integrally formed of resilient material by injection molding.

17. The underwater communicator of claim 15 further comprising a bit bar attached to said communicator and held in a diver's teeth for holding said air enclosure in a fluid tight relationship to a diver's face.

* * * * *